US010112314B2

(12) United States Patent
Takatsu et al.

(10) Patent No.: US 10,112,314 B2
(45) Date of Patent: Oct. 30, 2018

(54) POST-PROCESSING APPARATUS AND IMAGE FORMING APPARATUS FOR CORRECTING DEVIATION OF PUNCHING POSITION

(71) Applicant: Konica Minolta, Inc., Tokyo (JP)

(72) Inventors: Hiroaki Takatsu, Aichi (JP); Tatsuya Eguchi, Aichi (JP); Takeshi Ishida, Aichi (JP); Isao Watanabe, Aichi (JP); Taku Kimura, Aichi (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/456,120

(22) Filed: Mar. 10, 2017

(65) Prior Publication Data

US 2017/0259447 A1 Sep. 14, 2017

(30) Foreign Application Priority Data

Mar. 11, 2016 (JP) ..... 2016-048416

(51) Int. Cl.

| | |
|---|---|
| ***B26D 5/00*** | (2006.01) |
| ***B26D 5/32*** | (2006.01) |
| ***B26F 1/02*** | (2006.01) |
| ***B41J 11/00*** | (2006.01) |

(52) U.S. Cl.

CPC ..... *B26D 5/007* (2013.01); *B26D 5/32* (2013.01); *B26F 1/02* (2013.01); *B41J 11/0015* (2013.01)

(58) Field of Classification Search

CPC ..... B26F 1/02; B26D 5/32

See application file for complete search history.

(56) References Cited

U.S. PATENT DOCUMENTS 5,212,647 A * 5/1993 Raney ..... B26D 5/007 348/95
6,036,574 A * 3/2000 Halford ..... A63H 29/22 446/429
7,630,653 B2 * 12/2009 Bonino ..... G03G 15/50 347/117

(Continued)

FOREIGN PATENT DOCUMENTS

JP H05-104880 A 4/1993
JP H08-331361 A 12/1996

(Continued)

OTHER PUBLICATIONS

Office Action issued in corresponding Chinese Patent Application No. 201710133366X dated Jun. 25, 2018 (20 pages).

*Primary Examiner* — Shelby I Fidler
(74) *Attorney, Agent, or Firm* — Osha Liang LLP

(57) ABSTRACT

A post-processing apparatus includes: a moving mechanism configured to move a punching apparatus in a width direction orthogonal to a transportation direction of a sheet; and a sensor configured to optically detect a mark formed on the sheet and indicating a position to be punched. The mark is configured such that an interval in the transportation direction between a plurality of feature portions extending in the width direction is configured to be changed depending on the width direction. The moving mechanism is configured to determine a position of the punching apparatus in the width direction based on a difference between respective timings of detection of the plurality of feature portions.

7 Claims, 14 Drawing Sheets

(56) References Cited

U.S. PATENT DOCUMENTS

| | | | | |
|---|---|---|---|---|
| 2007/0172264 | A1* | 7/2007 | An | H04N 1/506 399/301 |
| 2009/0100976 | A1* | 4/2009 | Taguchi | B26F 1/02 83/628 |
| 2009/0206547 | A1 | 8/2009 | Tokita et al. | |
| 2013/0036886 | A1 | 2/2013 | Kato et al. | |

FOREIGN PATENT DOCUMENTS

| | | | |
|---|---|---|---|
| JP | 2006-035557 | A | 2/2006 |
| JP | 2009-190837 | A | 8/2009 |
| JP | 2013-053006 | A | 3/2013 |

* cited by examiner

LONG LINE SENSOR METHOD

LINE SENSOR MOVING METHOD

SENSOR INTEGRATED METHOD

METHOD ACCORDING TO EMBODIMENT

NOT DEVIATED

DEVIATED

| | AMOUNT OF MOVEMENT OF PUNCHING APPARATUS | AMOUNT OF MOVEMENT OF SENSOR | NUMBER OF DETECTING ELEMENTS USED FOR SENSOR |
|---|---|---|---|
| LONG LINE SENSOR METHOD | SMALL | NONE | LARGE |
| LINE SENSOR MOVING METHOD | SMALL | MEDIUM | SMALL |
| SENSOR INTEGRATED METHOD | LARGE | LARGE | SMALL |
| METHOD ACCORDING TO EMBODIMENT | SMALL | NONE | ONE |

POST-PROCESSING APPARATUS AND IMAGE FORMING APPARATUS FOR CORRECTING DEVIATION OF PUNCHING POSITION

This application is based on Japanese Patent Application No. 2016-048416 filed with the Japan Patent Office on Mar. 11, 2016, the entire content of which is hereby incorporated by reference.

BACKGROUND OF THE INVENTION

Field of the Invention

The present disclosure relates to a post-processing apparatus, more particularly, a post-processing apparatus having a punching function.

Description of the Related Art

Conventionally, post-processing apparatuses for punching a hole for binding or the like in a sheet have been known. Among these post-processing apparatuses, some post-processing apparatuses have a function of correcting a position of punching a sheet.

Regarding the art of correcting a position of punching a sheet, Japanese Laid-Open Patent Publication No. 2009-190837 discloses a sheet transporting apparatus including a transporting roller for transporting a sheet, wherein a CIS is provided to measure a position of a side end portion of the sheet transported by the transporting roller.

Moreover, Japanese Laid-Open Patent Publication No. 2013-053006 discloses a configuration including: first detecting means and second detecting means for detecting respective end portions of the sheet in the width direction, the sheet being arranged and transported along the sheet width direction; and correction means for correcting deviation of the sheet in the width direction by moving the sheet in the width direction based on a detected position of a first end portion in the width direction by the first detecting means, a detected position of a second end portion in the width direction by the second detecting means, and an amount of transportation of the sheet from the detected position in the transportation direction by the first detecting means to the detected position in the transportation direction by the second detecting means.

Moreover, in order to improve workability for an initial setting on a punching process, Japanese Laid-Open Patent Publication No. 2006-35557 discloses an image processing system configured to include: an image processing apparatus; and a post-processing apparatus configured to adjust a stop position of a sheet supplied (discharged) from the image processing apparatus by controlling transporting means (transporting roller or the like) for transporting the sheet and to punch the sheet having stopped being transported. More specifically, the post-processing apparatus detects a position of a punch hole based on an image of the punch hole on the sheet scanned by the image processing apparatus.

Regarding an art of avoiding punching at a portion at which an image is to be formed, Japanese Laid-Open Patent Publication No. H05-104880 discloses an image forming apparatus including: a hole providing unit for providing a hole in the sheet for the purpose of binding; and a transporting unit for transporting the sheet to/from the hole providing unit, wherein detecting means is provided to detect, in advance, presence/absence of an image at a hole provision position of the sheet and output it when the hole providing unit provides a hole in the sheet, and in response to the output of the detecting means, when there is the image at the hole provision position in the sheet, the hole providing unit and the transporting unit are controlled to provide a hole after moving the sheet to a position at which the image is not detected by the detecting means.

Regarding an art of indicating a pattern of punch hole positions or the like, Japanese Laid-Open Patent Publication No. H08-331361 discloses a copying/printing machine provided with: sheet information detecting means for detecting a size of a sheet of a print document or copy document and detecting an arrangement thereof on a transportation path in order to indicate a punch hole position indication or ruled line frame at a predetermined position of the sheet; and pattern signal generating means for generating a pattern electric signal for indicating a predetermined pattern on a predetermined portion of the sheet at its peripheral portion on the transportation path based on the output signal of the sheet information detecting means, wherein a composite signal of the indication electric signal and the pattern electric signal is supplied to indicating means.

SUMMARY OF THE INVENTION

Since the art disclosed in Japanese Laid-Open Patent Publication No. 2009-190837 is directed to a configuration using a line sensor, manufacturing cost is high.

Moreover, the art disclosed in Japanese Laid-Open Patent Publication No. 2013-053006 employs a configuration in which a moving mechanism for moving, in the sheet width direction, a sensor for detecting the end portion of the sheet in the width direction is independent from a moving mechanism for moving the punching apparatus. This results in high manufacturing cost of the moving mechanisms and complicated configuration and control.

Moreover, in the art disclosed in Japanese Laid-Open Patent Publication No. 2006-35557, the sheet provided with a punch hole needs to be detected by the scanner for correction of a punching position. This requires time and effort.

Moreover, the art disclosed in Japanese Laid-Open Patent Publication No. H05-104880 is directed to punching at a position at which the image is not detected when there is the image in the expected punching region, and does not take the correction of the position of punching the sheet into consideration at all.

Moreover, in the art disclosed in Japanese Laid-Open Patent Publication No. H08-331361, the pattern indicating the expected punching position or the ruled line frame is only printed on the sheet, and the correction of the position of punching the sheet is not taken into consideration at all.

The present disclosure has been made to solve the above-described problems, and an object in a certain aspect thereof is to provide a post-processing apparatus having a configuration simpler than that of a conventional art and capable of correcting deviation of a position of punching. An object in another aspect of the present disclosure is to provide an image forming apparatus configured to print a mark to be detected by the post-processing apparatus.

A post-processing apparatus includes: a transporting mechanism configured to transport a sheet in a predetermined transportation direction; a punching apparatus configured to punch the sheet; a moving mechanism configured to move the punching apparatus in a width direction orthogonal to the transportation direction; and a sensor disposed on a transportation path for the sheet, the sensor being configured to optically detect a mark formed on the sheet and indicating a position to be punched. The mark includes a plurality of feature portions extending in the width direction, and an interval between the feature portions in the transportation direction is configured to be changed depending on the width direction. The moving mechanism is configured to determine a position of the punching apparatus in the width direction based on a difference between respective timings of detection of the plurality of feature portions by the sensor.

In a certain aspect, the interval between the feature portions in the transportation direction is configured to be monotonously increased or monotonously decreased according to a change in the width direction.

In a certain aspect, the punching apparatus is configured to punch the sheet at a predetermined punching position when the sensor does not detect the mark.

In a certain aspect, the punching apparatus is configured to cancel punching the sheet when the sensor does not detect the mark.

In a certain aspect, the punching apparatus is configured to be capable of punching the sheet at a plurality of positions along the width direction at a predetermined interval. The mark is formed on the sheet at at least one of the plurality of positions to be punched by the punching apparatus.

In a certain aspect, the mark is formed at each of a plurality of positions of the sheet along the width direction. The sensor is configured to be capable of detecting the mark formed at each of the plurality of positions.

In a certain aspect, the punching apparatus is configured to be capable of punching the sheet at the plurality of positions along the width direction at independent timings. A punching timing is set in the punching apparatus for each of the plurality of positions based on a difference between a timing at which a predetermined feature portion included in a first mark of the marks at the plurality of positions is detected and a timing at which a predetermined feature portion included in a second mark of the marks at the plurality of positions is detected, the second mark being different from the first mark.

In a certain aspect, the punching apparatus is configured to cancel punching the sheet when the difference between the timing at which the first mark is detected and the timing at which the second mark is detected is not less than a predetermined value.

According to another aspect, an image forming apparatus configured to be connectable to a post-processing apparatus configured to punch a sheet includes: a transporting mechanism configured to transport the sheet in a predetermined transportation direction; and an image forming mechanism configured to print a mark onto a position of the sheet to be punched by the post-processing apparatus. The mark includes feature portions extending in a width direction orthogonal to the transportation direction, and an interval between the feature portions in the transportation direction is configured to be changed depending on the width direction.

In a certain aspect, the image forming mechanism is configured to print the mark within a region of the sheet expected to be punched by the post-processing apparatus.

In a certain aspect, the image forming apparatus is configured to be selectable between a punch mode in which the sheet is punched in the post-processing apparatus and a normal mode in which the sheet is not punched in the post-processing apparatus. The image forming mechanism is configured to print the mark on the sheet in the punch mode.

In a certain aspect, the image forming mechanism is configured to determine an amount of a toner or ink for printing the mark, based on a remaining amount of the toner or ink.

In a certain aspect, the image forming mechanism is configured to: be capable of forming a color image using toners or inks of a plurality of colors; and determine a color of a toner or ink for printing the mark, based on respective remaining amounts of the toners or inks of the plurality of colors.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1A:
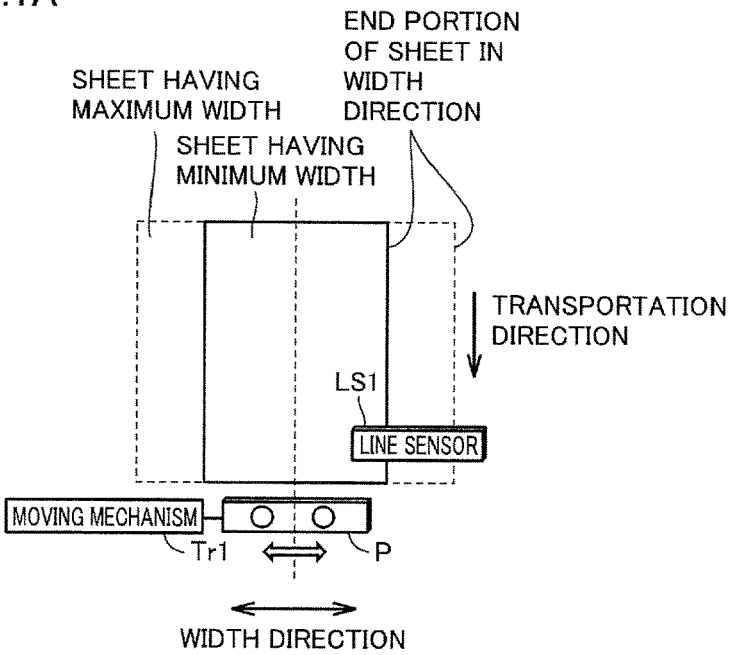
FIG. 1A illustrates a post-processing apparatus according to a long line sensor method.

The following describes an embodiment of the present invention in detail with reference to figures. It should be noted that the same or corresponding portions in the figures are given the same reference characters and are not described repeatedly.

[A. Related Art]

(a1. Long Line Sensor Method)

Figure 1B:
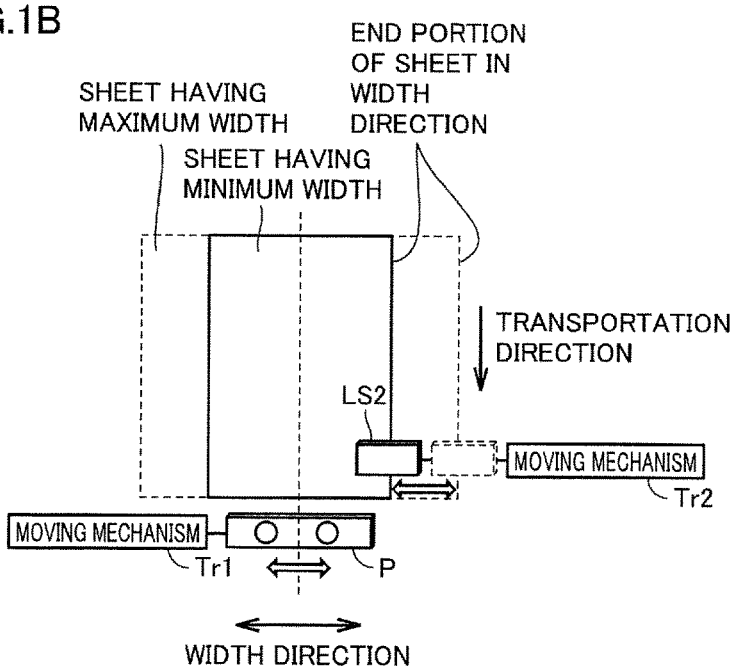
FIG. 1B illustrates a post-processing apparatus according to a line sensor moving method.
Figure 1C:
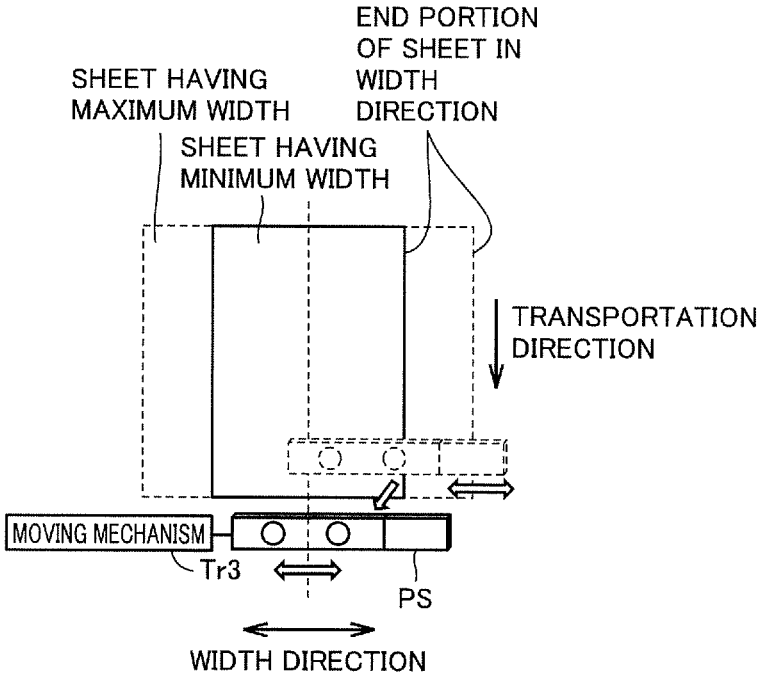
FIG. 1C illustrates a post-processing apparatus according to a sensor integrated method.

Each of FIG. 1A to FIG. 1C illustrates a post-processing apparatus according to a related art. FIG. 1A illustrates an exemplary configuration of a post-processing apparatus according to a long line sensor method. With reference to FIG. 1A, in the post-processing apparatus according to the long line sensor method, a line sensor LS1 is disposed at an upstream side in a transportation direction of sheet, and a punching apparatus P is disposed at a downstream side relative to line sensor LS1.

Line sensor LS1 is fixed to a predetermined position, and detects an end portion of the sheet in a width direction orthogonal to the transportation direction. Some sheets have small widths and other sheets have large widths. Hence, line sensor LS1 is configured to be long in the width direction in order to detect both the end portion of a sheet having a minimum width and the end portion of a sheet having a maximum width.

The post-processing apparatus according to the long line sensor method calculates a deviation amount of the sheet in the width direction by comparing the position of the end portion of the sheet in the width direction as determined according to the size of the sheet with the position of the end portion of the sheet in the width direction as detected by line sensor LS1.

The post-processing apparatus according to the long line sensor method employs a moving mechanism Tr1 to move punching apparatus P in the width direction based on the calculated deviation amount. Accordingly, punching apparatus P can correctly punch the sheet at an expected punching position.

However, the post-processing apparatus according to this method needs to use long line sensor LS1, thus resulting in high manufacturing cost, disadvantageously.

(a2. Line Sensor Moving Method)

FIG. 1B illustrates an exemplary configuration of a post-processing apparatus according to a line sensor moving method. With reference to FIG. 1B, in the post-processing apparatus according to the line sensor moving method, a line sensor LS2 is disposed at an upstream side in the transportation direction of sheet, and punching apparatus P is disposed at a downstream relative to line sensor LS2.

Line sensor LS2 is shorter in the width direction than line sensor LS1 according to the above-described long line sensor method, and is configured to be movable in the width direction. The post-processing apparatus according to the line sensor moving method employs a moving mechanism Tr2 to move line sensor LS2 based on the size of a sheet. More specifically, before a sheet passes, the post-processing apparatus moves line sensor LS2 to a position, in the width direction, at which the end portion of the sheet is expected to pass.

Accordingly, the post-processing apparatus according to the line sensor moving method can detect the end portion of the transported sheet in the width direction. Then, deviation of the sheet in the width direction can be corrected in a manner similar to the correction in the long line sensor method before punching the sheet.

According to the configuration, even though line sensor LS2 short in the width direction is employed in the post-processing apparatus according to the line sensor moving method, the deviation of the sheet in the width direction can be corrected before punching the sheet. However, in this configuration, it is necessary to provide the respective moving mechanisms for line sensor LS2 and punching apparatus P. Hence, this configuration leads to high manufacturing cost and complicated configuration and control, disadvantageously.

(a3. Sensor Integrated Method)

FIG. 1C illustrates an exemplary configuration of a post-processing apparatus according to a sensor integrated method. With reference to FIG. 1C, in the post-processing apparatus according to the sensor integrated method, a punching apparatus PS is disposed to punch a sheet. A line sensor is attached to and integrated with this punching apparatus PS.

The post-processing apparatus according to the sensor integrated method employs a moving mechanism Tr3 to move punching apparatus PS in advance based on the size of a sheet. More specifically, before a sheet passes, based on the size of the sheet, the post-processing apparatus moves the line sensor attached to punching apparatus PS, to a position, in the width direction, at which the end portion of the sheet is expected to pass.

The post-processing apparatus according to the sensor integrated method calculates a deviation amount of the sheet in the width direction based on the detected position of the end portion of the sheet as with the long line sensor method. The post-processing apparatus according to the sensor integrated method employs moving mechanism Tr3 to move punching apparatus PS in the width direction or the width direction and transportation direction, based on the calculated deviation amount. Accordingly, punching apparatus PS can correctly punch the sheet at an expected punching position.

However, in this configuration, punching apparatus PS integrated with the line sensor travels a long distance, thus resulting in a slow processing speed, disadvantageously. Moreover, each of the post-processing apparatuses according to the above-described related art employs the line sensor to detect the end portion of the sheet. Accordingly, in each of these post-processing apparatuses, manufacturing cost is high, disadvantageously. Therefore, the following describes a post-processing apparatus according to an embodiment in order to solve the problems in these post-processing apparatuses according to the related art.

[B. Overview]

Figure 2A:
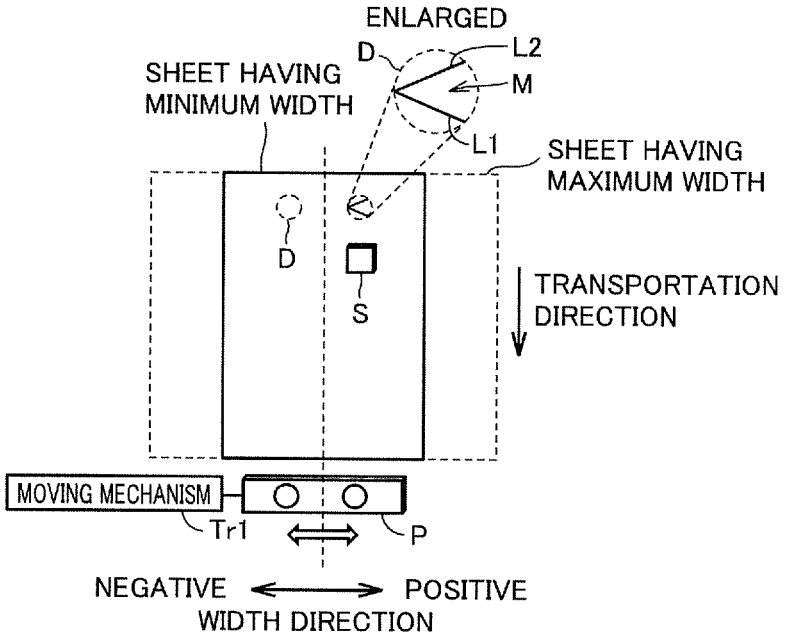
FIG. 2A is a (first) diagram illustrating an overview of a post-processing apparatus according to an embodiment.
Figure 2B:
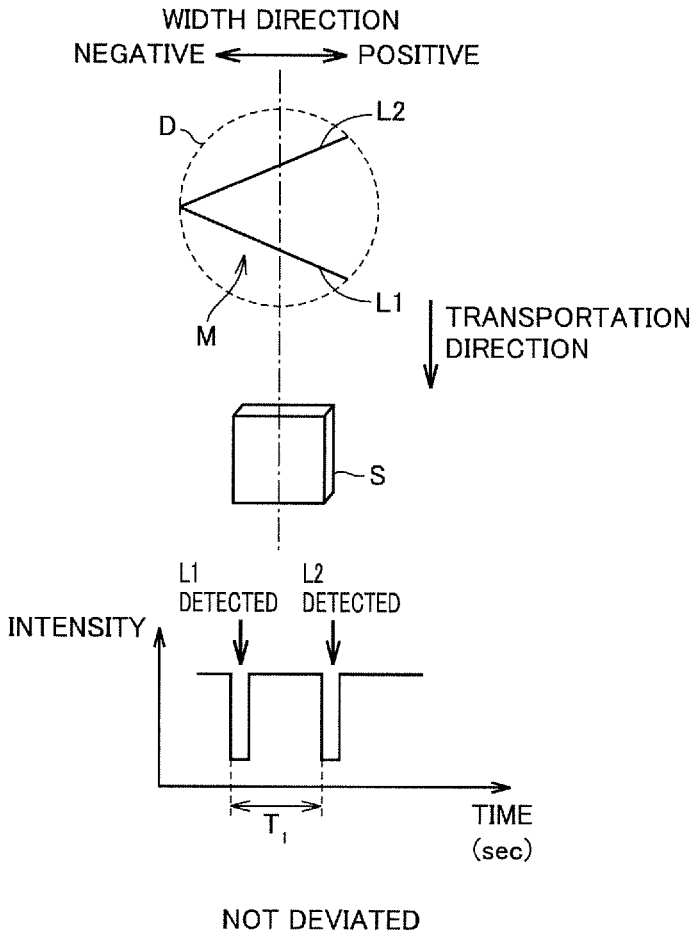
FIG. 2B is a (second) diagram illustrating an overview of the post-processing apparatus according to the embodiment.
Figure 2C:
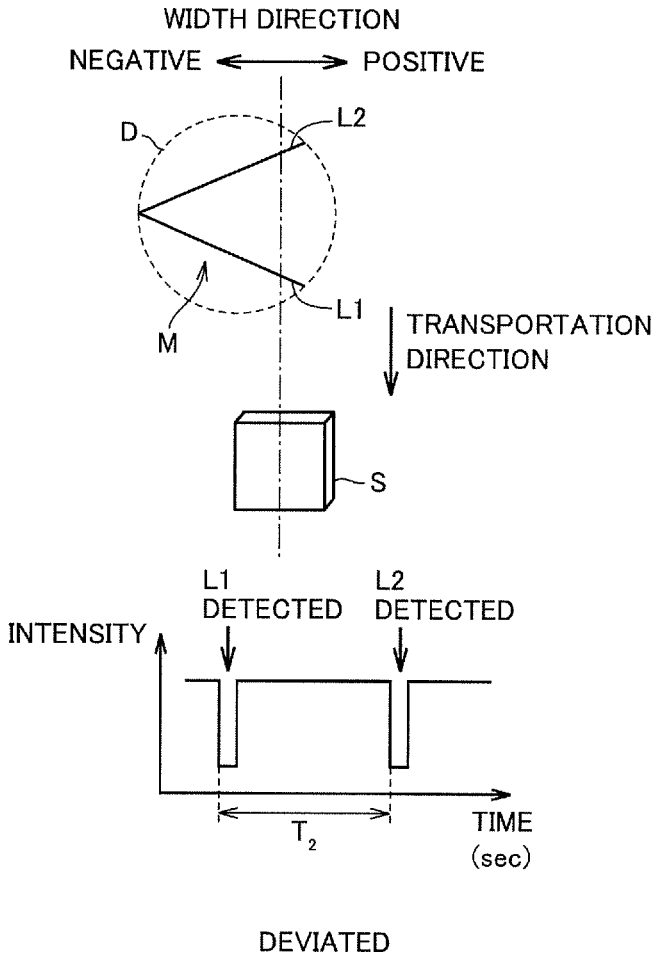
FIG. 2C is a (third) diagram illustrating an overview of the post-processing apparatus according to the embodiment.

Each of FIG. 2A to FIG. 2C illustrates an overview of the post-processing apparatus according to the embodiment. With reference to FIG. 2A, in the post-processing apparatus according to the embodiment, a detector S is disposed at an upstream side in a transportation direction of sheet, and a punching apparatus P is disposed at a downstream side relative to detector S. Detector S is a device configured to optically detect a mark M formed on a sheet. An example of detector S used herein is a light reflection type sensor having a pair of light transmitting unit and light receiving unit.

Detector S is disposed, on a transportation path for the sheet, at a width direction position corresponding to the width direction position of the sheet at which mark M is formed. More specifically, detector S is configured such that when the sheet is transported without being deviated in the width direction, light from the light transmitting unit is emitted to the center of an expected punching region D in the sheet width direction.

Mark M is formed within expected punching region D of the sheet. It should be noted that expected punching region D, which is indicated by a circle of broken line in FIG. 2A, may or may not be formed on the sheet.

Mark M includes a line L1 and a line L2, each of which serves as a feature portion. An interval between line L1 and line L2 in the transportation direction is configured to be changed depending on the width direction. In the example shown in FIG. 2A, the interval between line L1 and line L2 in the transportation direction is configured to be larger in proportion to a change in a positive width direction (rightward in the plane of sheet of FIG. 2A).

FIG. 2B illustrates that the sheet is not deviated in the width direction. With reference to FIG. 2B, when the sheet is transported without being deviated in the width direction, detector S detects a change of reflectance of light due to line L1 and line L2 at the center of expected punching region D in the sheet width direction.

A predetermined wavelength component of the light from the light transmitting unit of detector S is absorbed by line L1 and line L2. Accordingly, as shown in FIG. 2B, intensity of incoming light to the light receiving unit is decreased. Thus, detector S detects line L1 and line L2 in this order.

When the sheet is transported without being deviated in the width direction, detector S detects line L1, and, T1 second(s) later, detects line L2.

FIG. 2C illustrates that the sheet is deviated in the negative width direction. As shown in FIG. 2C, when the sheet is deviated in the negative width direction, T2 second(s), which is a time taken from the detection of line L1 to the detection of line L2 by detector S, are longer than T1 second(s).

The post-processing apparatus according to the embodiment calculates a deviation amount of the sheet in the width direction based on a difference between the T2 second(s) and the T1 second(s). Next, the post-processing apparatus according to the embodiment employs a moving mechanism Tr to move punching apparatus P in the negative width direction based on the calculated deviation amount. After being moved, punching apparatus P punches the sheet.

Figures 3, 4:
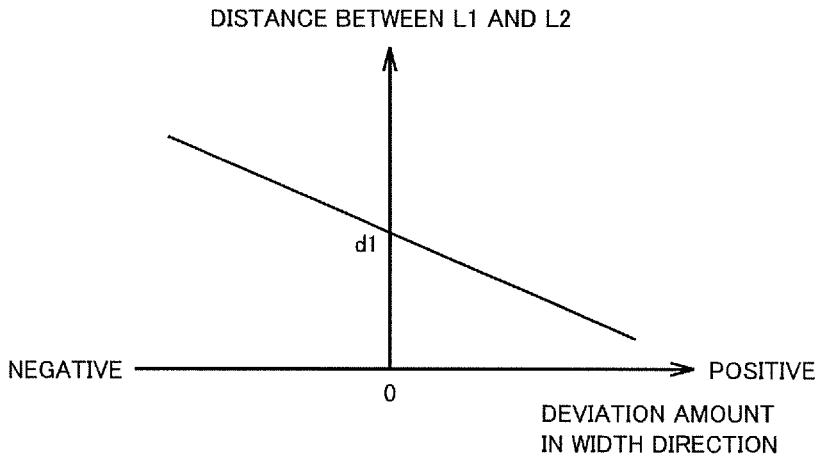
FIG. 3 illustrates an exemplary relation between a deviation amount in a width direction and a distance between feature portions.
FIG. 4 is a diagram for comparison between the post-processing apparatus according to the related art and the post-processing apparatus according to the embodiment.

FIG. 3 illustrates an exemplary relation between the deviation amount in the width direction and the distance between the feature portions. With reference to FIG. 3, the distance (difference between detection timings) in the transportation direction between line L1 and line L2 both serving as the feature portions is changed depending on the width direction. When the sheet is transported without being deviated in the width direction, it is assumed that the interval between line L1 and line L2 detected by detector S is a distance d1.

As shown in FIG. 2A, when the interval is configured to be larger in proportion to the change in the positive width direction, the distance between line L1 and line L2 in the transportation direction becomes shorter than distance d1 as the sheet is deviated more in the positive width direction. On the other hand, the distance between line L1 and line L2 in the transportation direction becomes longer than distance d1 as the sheet is deviated more in the negative width direction.

According to the description above, the post-processing apparatus according to the embodiment can correct the deviation of the sheet in the width direction based on the difference between the timings at which the plurality of feature portions included in the mark formed in the sheet are detected. Accordingly, the sheet can be punched precisely at expected punching region D.

Further, the post-processing apparatus according to the embodiment can calculate the deviation amount of the sheet in the width direction by only scanning the mark formed in the sheet, using the light reflection type sensor having the pair of light transmitting unit and light receiving unit. Hence, the post-processing apparatus according to the embodiment can correct the deviation of the punching position with such a configuration simpler and less expensive than that of the conventional art.

FIG. 4 is a diagram for comparison between each of the post-processing apparatuses according to the related art and the post-processing apparatus according to the embodiment. With reference to FIG. 4, as the amount of movement of the punching apparatus and the amount of movement of the sensor are smaller, the processing speed is more improved and a simpler moving mechanism can be realized. Moreover, as the number of detecting elements used for the sensor is smaller, the manufacturing cost can be suppressed more.

The post-processing apparatus according to the long line sensor method has a large number of detecting elements used for the sensor, thus resulting in high manufacturing cost. The post-processing apparatus according to the line sensor moving method requires respective moving mechanisms for driving the punching apparatus and the sensor, thus resulting in high manufacturing cost and complicated configuration and control. In the post-processing apparatus according to the sensor integrated method, the amounts of movement of the punching apparatus and the sensor are large, thus resulting in a low processing speed. Moreover, the post-processing apparatus according to each of the line sensor moving method and the sensor integrated method employs a line sensor, thus resulting in high manufacturing cost although the manufacturing cost is lower than that of the sensor used for the long line sensor method.

On the other hand, in the post-processing apparatus according to the embodiment, the amount of movement of the punching apparatus is small, thus attaining a simple moving mechanism and high processing performance. Moreover, in the post-processing apparatus according to the embodiment, the sensor is not moved, so that it is not necessary to provide an independent moving mechanism for the sensor. Moreover, in the post-processing apparatus according to the embodiment, one detecting element is used for the sensor. Hence, the configuration of the post-processing apparatus according to the embodiment is simpler than that of the post-processing apparatus according to the related art, thereby suppressing the manufacturing cost. Hereinafter, the configuration and control of this post-processing apparatus will be described in detail.

[C. First Embodiment]

Figure 5:
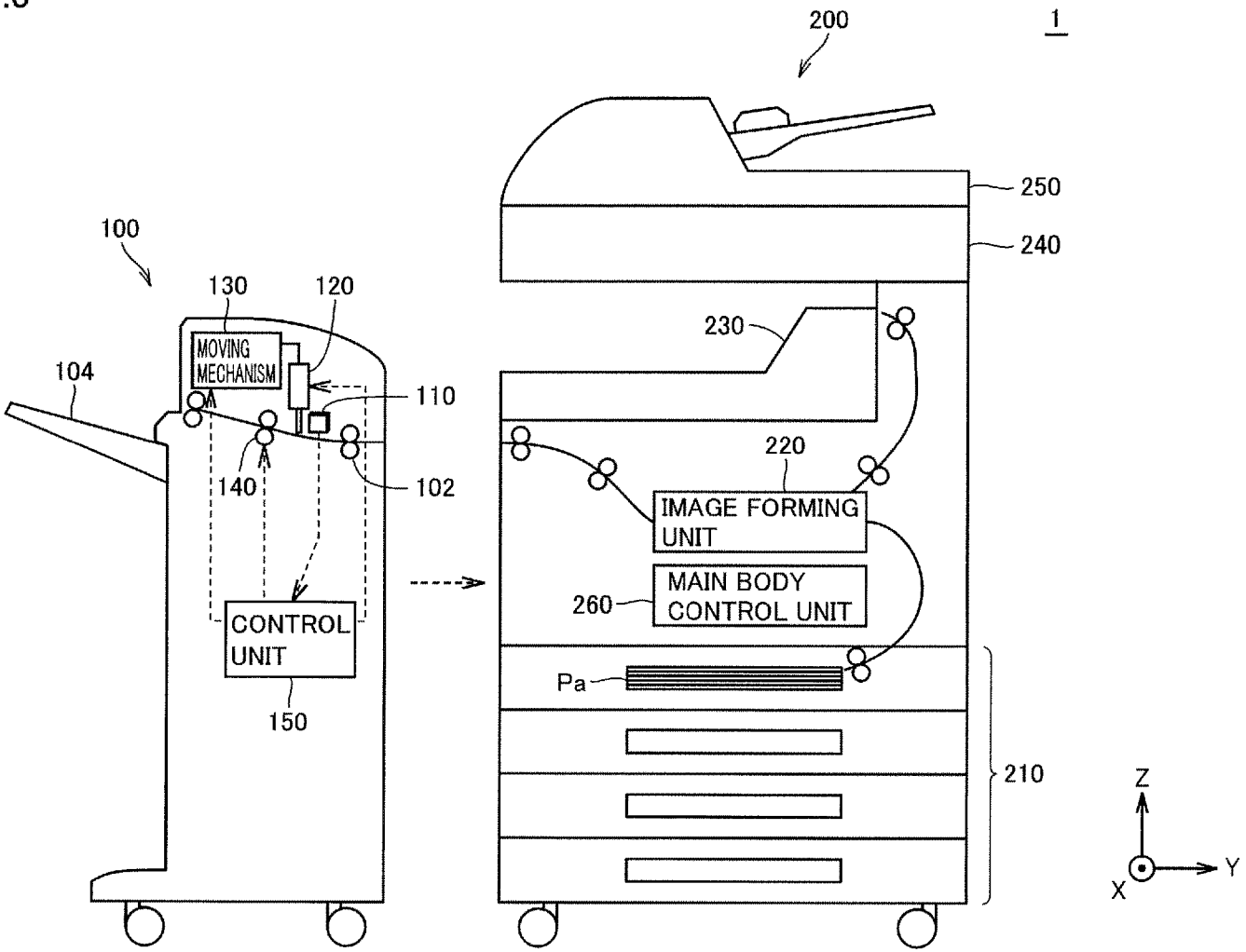
FIG. 5 illustrates an exemplary configuration of an image forming system according to a first embodiment.

FIG. 5 illustrates an exemplary configuration of an image forming system 1 according to a first embodiment. As shown in FIG. 5, image forming system 1 includes: a post-processing apparatus 100; and an image forming apparatus 200 configured to be connectable to post-processing apparatus 100.

(c1. Image Forming Apparatus 200)

Image forming apparatus 200 has a sheet supply cassette 210, an image forming unit 220, a sheet discharging unit 230, a scanner 240, an automatic document feeder 250, and a main body control unit 260.

Main body control unit 260 is configured to be switchable between a punch mode in which a sheet Pa is punched in post-processing apparatus 100 and a normal mode in which sheet Pa is not punched in post-processing apparatus 100 as described below.

Scanner 240 scans image data formed on a document and outputs it to main body control unit 260. Sheet supply cassette 210 supplies sheets Pa one by one from the uppermost sheet to the transportation path in response to a request from main body control unit 260.

Image forming unit 220 forms, onto sheet Pa (recording material), the image data received from main body control unit 260. In the punch mode, main body control unit 260 superimposes image data for forming mark 170 on the image data scanned by scanner 240 or image data designated by a user, and outputs the superimposed image data to image forming unit 220.

In the normal mode, image forming unit 220 transports, to sheet discharging unit 230, sheet Pa having an image formed thereon. On the other hand, in the punch mode, image forming unit 220 transports, to post-processing apparatus 100, sheet Pa having an image formed thereon.

(c2. Post-Processing Apparatus 100)

Post-processing apparatus 100 has transporting roller pairs 102, 140, a sheet discharging unit 104, a detector 110, a punching apparatus 120, a moving mechanism 130, and a control unit 150.

Control unit 150 is electrically connected to detector 110, punching apparatus 120, moving mechanism 130, and transporting roller pair 140.

Post-processing apparatus 100 employs transporting roller pair 102 to transport sheet Pa received from image forming apparatus 200. Detector 110 detects mark 170 formed on transported sheet Pa, and outputs it to control unit 150. Detector 110 is configured to optically detect mark 170. An example of detector 110 used herein is a light reflection type sensor having a pair of light transmitting unit and light receiving unit. It should be noted that in another aspect, detector 110 may be a CCD (Charge-Coupled Device) image sensor.

Based on a result of the detection of mark 170 by detector 110, control unit 150 causes moving mechanism 130 to move punching apparatus 120 in the width direction orthogonal to the transportation direction of sheet Pa.

Sheet Pa transported by transporting roller pair 102 is brought into abutment with transporting roller pair 140 having stopped being rotated, thereby correcting deviation in the transportation direction and temporarily stopping the transportation. Punching apparatus 120 punches sheet Pa when the transportation of sheet Pa is stopped temporarily. The sheet punched by punching apparatus 120 is discharged to sheet discharging unit 104.

It should be noted that in another aspect, post-processing apparatus 100 may be configured to include processing units configured to perform processes other than the punch process, such as a folding processing unit configured to fold the sheet, a staple processing unit configured to provide a staple to a predetermined position of the sheet, and the like.

(c3. Control Unit 150)

Figure 6:
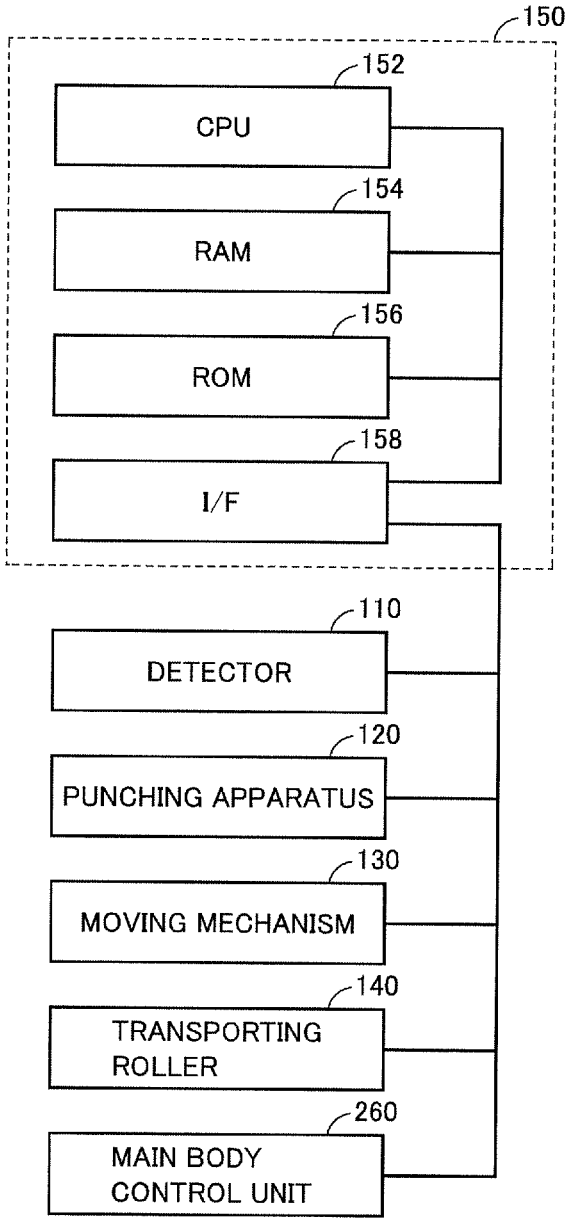
FIG. 6 illustrates an exemplary electric configuration of a post-processing apparatus according to the first embodiment.

FIG. 6 illustrates an exemplary electric configuration of post-processing apparatus 100 according to the first embodiment. With reference to FIG. 6, as main control elements, control unit 150 includes a CPU (Central Processing Unit) 152, a RAM (Random Access Memory) 154, a ROM (Read Only Memory) 156, and an interface (I/F) 158.

CPU 152 reads and executes a below-described program stored in ROM 156 or the like, thereby implementing the entire process of post-processing apparatus 100. It should be noted that CPU 152 may be any one of a microprocessor, an FPGA (Field Programmable Gate Array), an ASIC (Application Specific Integrated Circuit), a DSP (Digital Signal Processor), and other circuits having a calculation function.

Typically, RAM 154 is a DRAM (Dynamic Random Access Memory) or the like, and is configured to temporarily store image data and data necessary for CPU 152 to operate a program. Hence, RAM 154 functions as a so-called working memory.

Typically, ROM 156 is a flash memory or the like, and is configured to store a program to be executed by CPU 152 or various types of setting information in relation with an operation of post-processing apparatus 100.

Interface 158 is electrically connected to and exchanges a signal with detector 110, punching apparatus 120, moving mechanism 130, transporting roller pair 140, and main body control unit 260 included in image forming apparatus 200.

(c4. Control for Correcting Punching Position)

Figure 7:
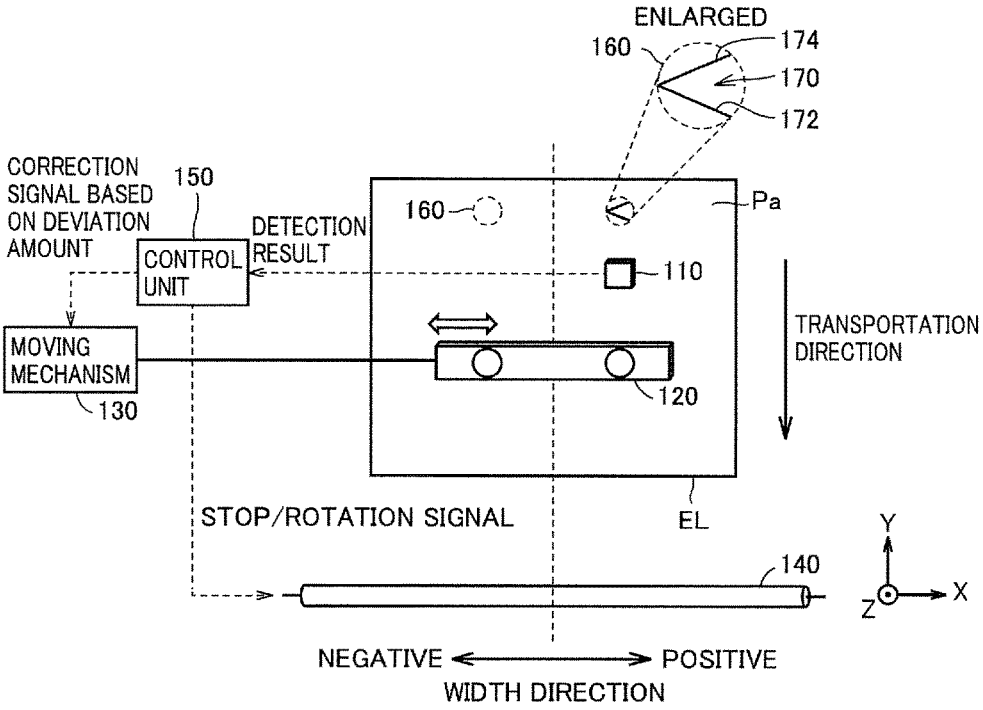
FIG. 7 illustrates control for correcting a punching position according to the first embodiment.

Next, the following describes control for correcting a position of punching by punching apparatus 120, based on the detection result of mark 170. FIG. 7 illustrates the control for correcting the punching position according to the first embodiment.

Sheet Pa is transported from the upstream to the downstream along the transportation path. Detector 110 detects a downstream end portion EL of sheet Pa in the sheet transportation direction. More specifically, on the transportation path, downstream end portion EL of sheet Pa first passes through the irradiation position to which the light transmitting unit included in detector 110 emits light. The light receiving unit included in detector 110 detects a change in intensity of received light reflected from sheet Pa, and outputs the detection result to control unit 150. Based on the change in the intensity of the received light, control unit 150 determines that downstream end portion EL of sheet Pa has passed through the detection position of detector 110.

Next, detector 110 detects mark 170 formed on sheet Pa and indicating expected punching region 160. Expected punching region 160 represents a position to be punched by punching apparatus 120. Specifically, control unit 150 detects mark 170 based on the detection result from detector 110 after passage of a predetermined time from the detection of downstream end portion EL of sheet Pa. As one example, the predetermined time corresponds to a value obtained by dividing a distance from downstream end portion EL to expected punching region 160 in the sheet transportation direction by the transportation speed of sheet Pa. It should be noted that expected punching region 160, which is indicated by a broken line in FIG. 7, may or may not be formed on sheet Pa.

More specifically, control unit 150 detects a line 172 and a line 174 included in mark 170. These lines 172 and 174 are feature portions of mark 170 extending in the width direction.

As one example, when sheet Pa is transported without being deviated in the width direction, detector 110 is disposed to emit light from the light transmitting unit of detector 110 to the center of expected punching region 160 in the width direction.

ROM 156 of control unit 150 stores, in advance, a time interval (hereinafter, also referred to as "appropriate time") from the detection of line 172 to the detection of line 174 by detector 110 when sheet Pa is transported without being deviated in the width direction.

When a time interval (hereinafter, also referred to as "detection time") from actual detection of line 172 to actual detection of line 174 by detector 110 is equal to the appropriate time, control unit 150 determines that sheet Pa is transported without being deviated in the width direction.

On the other hand, when the detection time is different from the appropriate time, control unit 150 determines that sheet Pa is transported with sheet Pa being deviated in the width direction. As one example, it is assumed that the interval between line 172 and line 174 in the transportation direction is configured to be larger according to a change in the positive width direction as shown in FIG. 6. Under such a condition, when the detection time is shorter than the appropriate time, control unit 150 determines that sheet Pa is deviated in the positive width direction. Moreover, when the detection time is longer than the appropriate time, detector 150 determines that sheet Pa is deviated in the negative width direction.

Control unit 150 calculates the deviation amount in the width direction of sheet Pa based on a difference between the detection time and the appropriate time. Then, control unit 150 outputs, to moving mechanism 130, a correction signal that is based on the calculated deviation amount.

Figure 8:
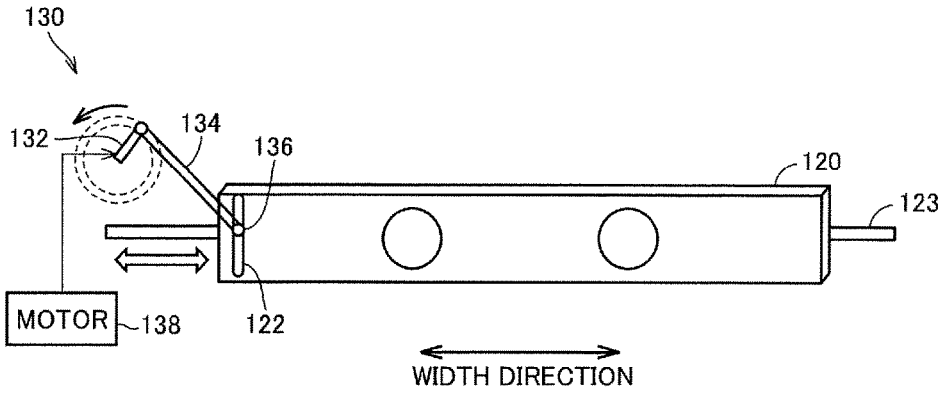
FIG. 8 illustrates an exemplary configuration of a moving mechanism according to the first embodiment.

FIG. 8 illustrates an exemplary configuration of moving mechanism 130 according to the first embodiment. With reference to FIG. 8, moving mechanism 130 includes: a crank mechanism including a rotation section 132, a coupling section 134, and a shaft 136; and a motor 138. A groove 122 is provided in punching apparatus 120. Shaft 136 of the crank mechanism is inserted in groove 122.

When rotation section 132 is rotated by motor 138, punching apparatus 120 is moved, via coupling section 134 and shaft 136, in the width direction along a rail 123 with which punching apparatus 120 is engaged. Motor 138 adjusts the rotation angle of rotation section 132 based on the correction signal received from control unit 150. Accordingly, moving mechanism 130 can adjust the position of punching apparatus 120 in the width direction. As a result, punching apparatus 120 can punch at expected punching region 160.

With reference to FIG. 7 again, a specific example will be described hereinafter. In the present embodiment, as one example, it is assumed that expected punching region 160 has a circular shape having a diameter of 6 mm, and the transportation speed of sheet Pa is 500 mm/sec. Moreover, in the present embodiment, as one example, lines 172 and 174 are configured to form an angle of 50° relative to each other from the end portion of expected punching region 160 in the negative width direction on the center line thereof in the transportation direction. Moreover, it is assumed that an interval therebetween in the transportation direction is configured to be larger in proportion to a change in the positive width direction. In this case, the appropriate time is 5.6 msec.

Under such a condition, if the detection time is 9.3 msec, control unit 150 determines that sheet Pa is deviated by 2 mm from its proper position in the negative width direction. Specifically, control unit 150 calculates a deviation amount X (mm) of sheet Pa in the width direction based on the following formula (1):

[Formula 1]

$$X = \frac{Td}{2} \times 500 \Big/ \tan\left(\frac{50}{2}\right)^{\circ} \tag{1}$$

Td (sec) is a deviation time obtained by subtracting the appropriate time from the detection time. It should be noted that in another aspect, control unit 150 may store, in ROM 156 in advance, a table in which deviation time Td is associated with deviation amount X, and may calculate deviation amount X by making reference to the table. According to the configuration, control unit 150 can calculate deviation amount X based on the detection time. In other words, control unit 150 can skip the calculation process that is based on the formula (1) above. Accordingly, the configuration can improve the processing speed for calculating deviation amount X.

Based on the calculation result, control unit 150 outputs, to moving mechanism 130, a correction signal indicating to move punching apparatus 120 by 2 mm from the expected punching position in the negative width direction. Based on the correction signal received from control unit 150, moving mechanism 130 moves, in the negative width direction by 2 mm, punching apparatus 120 located at the expected punching position.

Sheet Pa is brought into abutment with transporting roller pair 140 having stopped being rotated, thereby correcting the deviation in the transportation direction by transporting roller pair 140. Moreover, the transportation is temporarily stopped due to sheet Pa being in abutment with transporting roller pair 140. Punching apparatus 120, which has been moved in the negative width direction by 2 mm from the expected punching position, punches sheet Pa having stopped being transported. Accordingly, punching apparatus 120 can precisely punch at expected punching region 160.

After punching by punching apparatus 120, control unit 150 outputs a rotation signal to transporting roller pair 140. In response to the input of the signal, transporting roller pair 140 is forwardly rotated in the sheet transportation direction to transport sheet Pa. Accordingly, punched sheet Pa is discharged to sheet discharge unit 104.

According to the description above, post-processing apparatus 100 according to the present embodiment can calculate the deviation of the sheet in the width direction based on the difference between the respective timings at which line 172 and line 174 serving as the feature portions included in mark 170 are detected, and can correct the position of punching by punching apparatus 120.

Moreover, by using detector 110 having the single detecting element, the manufacturing cost of post-processing apparatus 100 can be suppressed and the size of detector 110 can be reduced.

Moreover, by using moving mechanism 130 having the simple configuration as a configuration for moving punching apparatus 120, the manufacturing cost of post-processing apparatus 100 can be suppressed. Moreover, since the amount of movement of punching apparatus 120 in the width direction is small, post-processing apparatus 100 has high processing performance for the process of correcting the punching position.

Moreover, mark 170 is formed within expected punching region 160 to be punched by punching apparatus 120. Accordingly, when punched by punching apparatus 120, mark 170 does not remain on the sheet discharged from sheet discharging unit 104 and only image information intended by the user is formed thereon.

It should be noted that in FIG. 7, mark 170 is printed only in one expected punching region 160, corresponding to detector 110, of two expected punching regions 160; however, mark 170 may be printed in each of expected punching regions 160.

Figure 9:
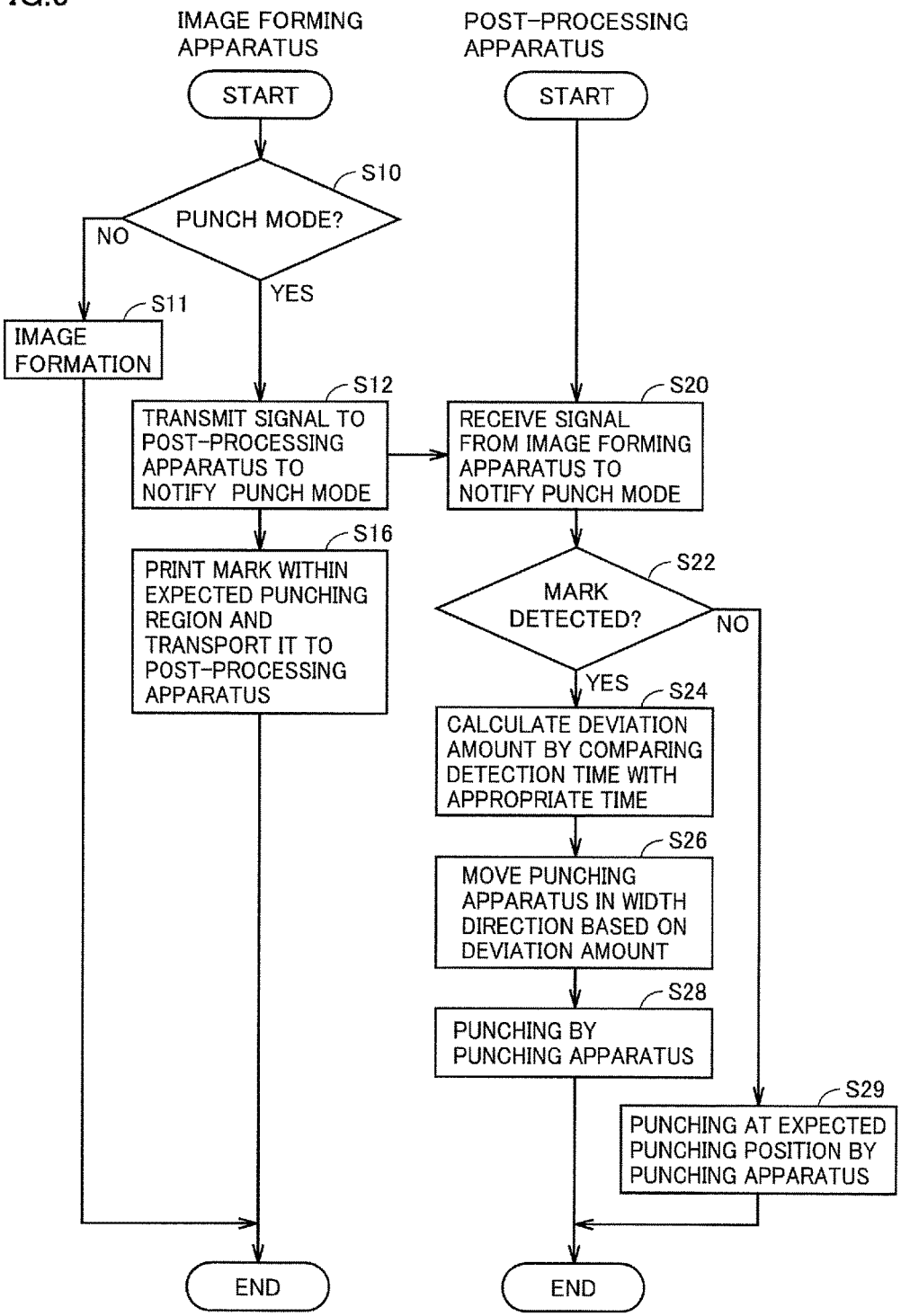
FIG. 9 is a flowchart illustrating control of the post-processing apparatus and image forming apparatus according to the first embodiment.

The following describes the above-described control with reference to FIG. 9. FIG. 9 is a flowchart illustrating the control of post-processing apparatus 100 and image forming apparatus 200 according to the first embodiment. The process shown in FIG. 9 is implemented when control unit 150 of post-processing apparatus 100 and main body control unit 260 of image forming apparatus 200 execute control programs stored in storage units thereof. In another aspect, part or whole of the process may be performed by a circuit element and other hardware. It is assumed that these conditions are the same also in other flowcharts.

In a step S10, image forming apparatus 200 receives a print job, and determines whether or not the print job is set at the punch mode.

When image forming apparatus 200 determines that the print job received in step S10 is in the normal mode (NO in step S10), the process is transferred to a step S11. In step S11, image forming apparatus 200 performs image formation without printing mark 170 on sheet Pa, and then discharges the sheet to sheet discharging unit 230.

On the other hand, when image forming apparatus 200 determines that the print job received in step S10 is in the punch mode (YES in step S10), the process is transferred to a step S12.

In step S12, image forming apparatus 200 outputs, to post-processing apparatus 100, a signal notifying that the print job is in the punch mode.

In a step S20, post-processing apparatus 100 receives, from image forming apparatus 200, the signal notifying that the print job is in the punch mode, and performs preparation operations such as initialization of the position of punching apparatus 120 in the width direction or start of rotation of transporting roller pair 102.

In a step S16, onto sheet Pa, image forming apparatus 200 prints the image information designated by the user, and prints mark 170 within expected punching region 160. Then, image forming apparatus 200 transports the printed sheet Pa to post-processing apparatus 100.

In step S22, post-processing apparatus 100 determines whether or not mark 170 has been detected by detector 110.

More specifically, based on the output (detection result) of detector 110, control unit 150 of post-processing apparatus 100 detects downstream end portion EL of sheet Pa in the transportation direction. Then, when detection results corresponding to line 172 and line 174, which are the feature portions included in mark 170, are not obtained even after passage of a predetermined time from the detection of downstream end portion EL, control unit 150 determines that mark 170 has not been detected.

When post-processing apparatus 100 determines that mark 170 has not been detected in step S22 (NO in step S22), the process is transferred to a step S29. In step S29, post-processing apparatus 100 causes punching apparatus 120 to punch sheet Pa at the expected punching position.

On the other hand, when post-processing apparatus 100 determines that mark 170 has been detected in step S22 (YES in step S22), the process is transferred to a step S24.

In step S24, post-processing apparatus 100 calculates the deviation amount of sheet Pa in the width direction by comparing the detection time with the appropriate time.

In a step S26, post-processing apparatus 100 causes moving mechanism 130 to move punching apparatus 120 from the expected punching position by the calculated deviation amount in the width direction.

In a step S28, post-processing apparatus 100 punches sheet Pa with the transportation of sheet Pa being stopped.

According to the description above, post-processing apparatus 100 according to the present embodiment employs detector 110 to detect mark 170 formed on the sheet, thereby calculating the deviation of the sheet in the width direction to correct the position of punching by punching apparatus 120.

It should be noted that in another aspect, when mark 170 is not detected, post-processing apparatus 100 may be configured to cancel punching the sheet in step S29. Furthermore, in another aspect, when mark 170 is not detected, post-processing apparatus 100 may be configured to be selectable whether to punch the sheet at the expected punching position or to cancel punching the sheet.

Moreover, in another aspect, post-processing apparatus 100 may employ a different method to detect the mark in step S22. As one example, transporting roller pair 102 is stopped being rotated in order to stop the transportation of sheet Pa for a predetermined time, and is then forwardly rotated in the transportation direction again. Instead of using, as a reference, the time at which downstream end portion EL of sheet Pa is detected by detector 110, control unit 150 uses, as the reference, the time at which the transporting roller pair 102 starts to be rotated again. That is, based on the detection result of detector 110 after passage of a predetermined time from the above-described time used as the reference, control unit 150 determines that the mark has been detected when the detection results corresponding to line 172 and line 174 are obtained.

[D. Second Embodiment]

In the first embodiment, it has been illustrated that the deviation amount of the sheet in the width direction is calculated using one detector to correct the deviation. A post-processing apparatus 100A in the present embodiment employs two detectors to correct not only the deviation of the sheet in the width direction but also deviation of the sheet in the transportation direction. The following describes configuration and control of post-processing apparatus 100A according to the second embodiment. It should be noted that since the basic configuration of post-processing apparatus 100A according to the second embodiment is substantially the same as post-processing apparatus 100 according to the first embodiment, the following only describes a difference therefrom.

Figure 10A:
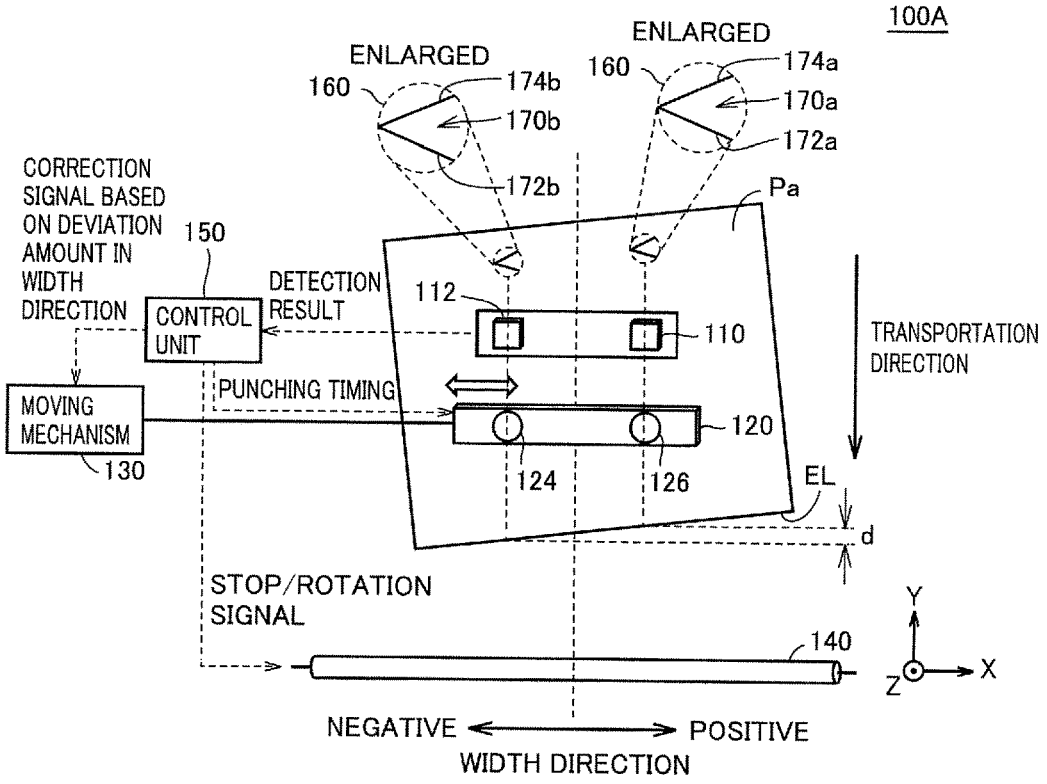
FIG. 10A shows an exemplary configuration of a post-processing apparatus according to a second embodiment.
Figure 10B:
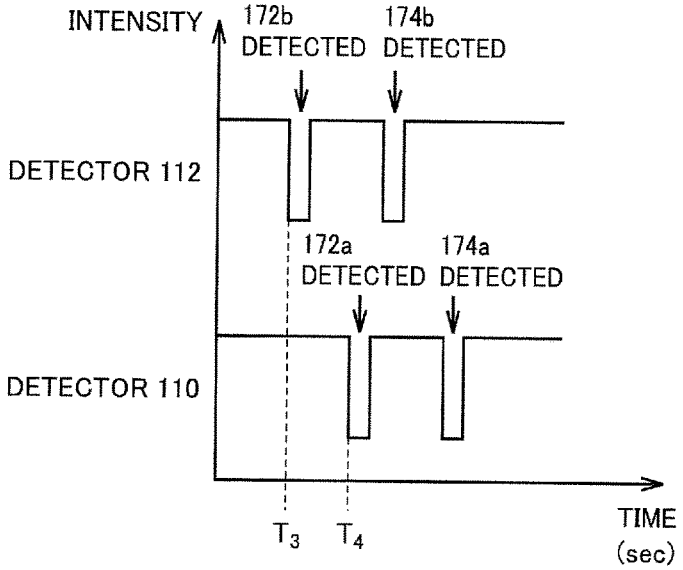
FIG. 10B illustrates correction of a punching position in a transportation direction.

FIG. 10A shows an exemplary configuration of post-processing apparatus 100A according to the second embodiment. FIG. 10B illustrates correction of the punching position in the transportation direction. It should be noted that portions having the same reference characters as those in FIG. 7 are the same as those in FIG. 7 and are not repeatedly described.

(d1. Configuration of Post-Processing Apparatus 100A and Mark Formed on Sheet Pa)

With reference to FIG. 10A, in addition to detector 110, post-processing apparatus 100A has a detector 112. Detectors 110 and 112 are disposed at corresponding positions in the transportation direction. In the present embodiment, punching apparatus 120A is configured to punch sheet Pa at two positions. Moreover, punching apparatus 120A is configured to punch at the two positions at independent timings by using punch motors 124, 126.

In sheet Pa, identical marks are formed on the two positions, i.e., expected punching regions 160. As one example, when sheet Pa is transported without being deviated in the width direction and the transportation direction, each of detectors 110 and 112 is disposed to emit light from the light transmitting unit thereof to the center of a corresponding expected punching region 160 in the width direction.

Post-processing apparatus 100A employs one of detectors 110 and 112 to calculate the deviation amount of sheet Pa in the width direction and correct the deviation using moving mechanism 130 in a manner similar to that in the first embodiment.

In post-processing apparatus 100 according to the first embodiment, punching by punching apparatus 120 is performed with sheet Pa being in abutment with transporting roller pair 140 and stopped being transported; however, in post-processing apparatus 100A according to the present embodiment, punching by punching apparatus 120A is performed during the transportation of sheet Pa.

(d2. Control for Correcting Deviation of Sheet in Transportation Direction)

Based on a timing at which detector 110 detects a mark 170*a* and a timing at which detector 112 detects a mark 170*b*, post-processing apparatus 100A can correct the deviation amount of sheet Pa in the transportation direction before punching.

If sheet Pa is not deviated in the transportation direction, the timing at which detector 110 detects mark 170*a* becomes the same as the timing at which detector 112 detects mark 170*b*. On the other hand, when sheet Pa is deviated in the transportation direction, the timings at which the respective detectors detect the corresponding marks become different from each other.

As one example, as shown in FIG. 10A, the following describes a case where mark 170*b* formed in the negative width direction is deviated, by a distance d to the downstream side in the transportation direction, relative to mark 170*a* formed in the positive width direction.

In this case, as shown in FIG. 10B, at a time T3, detector 112 detects a line 172*b*. At a time T4 having passed from time T3 by a time obtained by dividing distance d by the transportation speed, detector 110 detects a line 172*a*. Line 172*a* and line 172*b* are feature portions corresponding to each other.

After passage of a predetermined time from the detection of line 172*a* by detector 110, control unit 150 outputs, to punching apparatus 120A, a control signal for driving punch motor 126. Moreover, after passage of the predetermined time from the detection of line 172*b* by detector 112, control unit 150 outputs, to punching apparatus 120A, a control signal for driving punch motor 124. As one example, the predetermined time refers to a time obtained by dividing, by the transportation speed of sheet Pa, a distance between detector 110 (and 112) and punching apparatus 120A in the transportation direction.

According to the description above, post-processing apparatus 100A according to the present embodiment can correct not only the deviation of sheet Pa in the width direction but also the deviation of sheet Pa in the transportation direction before punching. Moreover, post-processing apparatus 100A according to the present embodiment can punch during the transportation of sheet Pa, thereby improving processing performance.

It should be noted that the transportation speed of sheet Pa when passing through punching apparatus 120A, i.e., the transportation speed of transporting roller pair 102, is preferably set to be lower than the transportation speed in a different step (for example, the transportation speed of transporting roller pair 140). This leads to improved positional accuracy in punching sheet Pa by punching apparatus 120A during the transportation.

Figure 11:
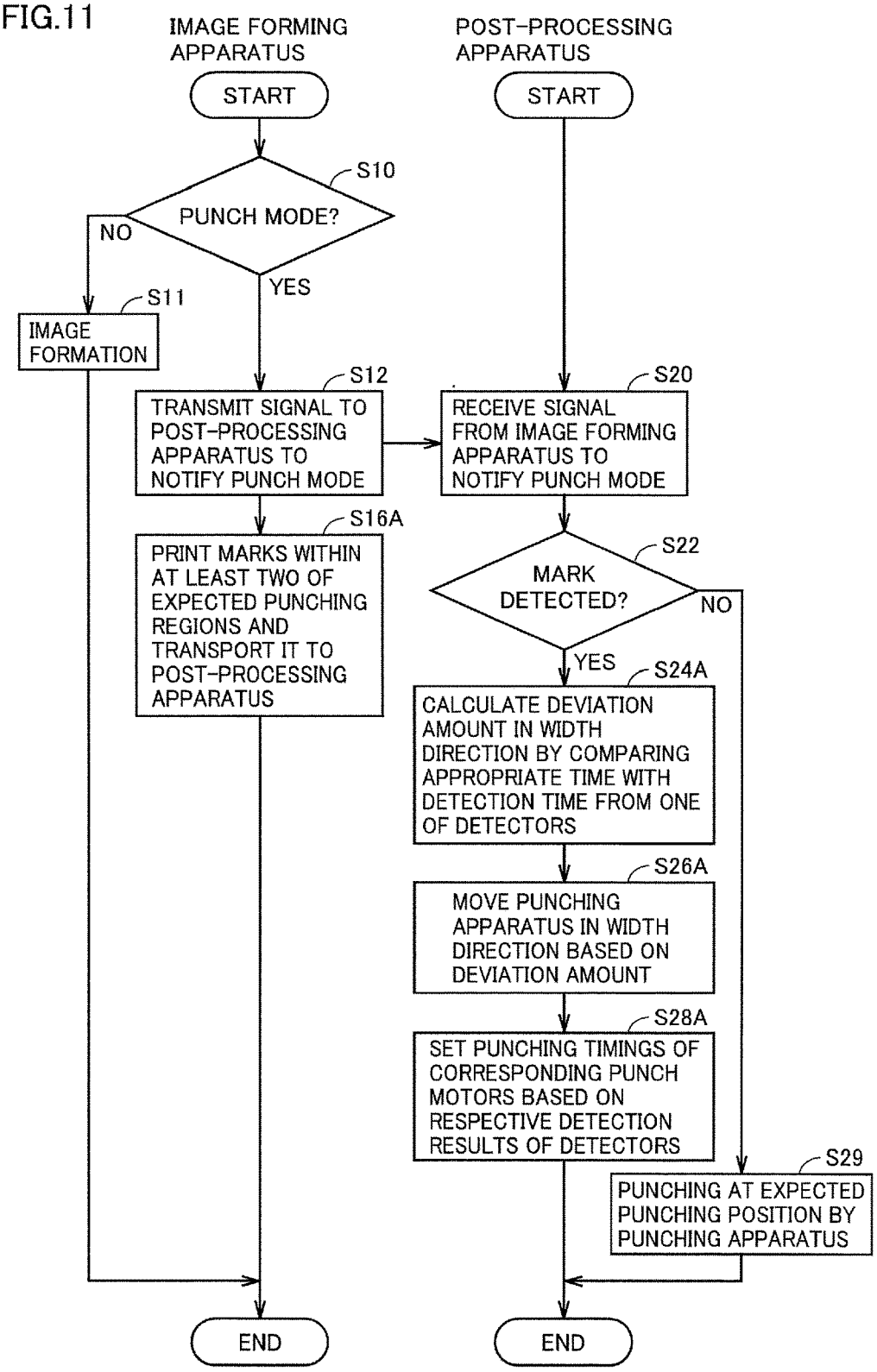
FIG. 11 is a flowchart illustrating control of the post-processing apparatus and image forming apparatus according to the second embodiment.

The following describes the above-described control with reference to FIG. 11. FIG. 11 is a flowchart illustrating control of post-processing apparatus 100A and image forming apparatus 200 according to the second embodiment. It should be noted that portions given the same reference characters as those in FIG. 9 represent the same processes as those in FIG. 9. Hence, the processes are not repeatedly described.

With reference to FIG. 11, in a step S16A, image forming apparatus 200 prints, onto sheet Pa, image information designated by the user and prints marks within at least two of the plurality of expected punching regions 160. The two expected punching regions are expected punching regions 160 corresponding to the positions, at which detector 110 and detector 112 are disposed, in the width direction. Then, image forming apparatus 200 transports printed sheet Pa to post-processing apparatus 100A.

In a step S24A, post-processing apparatus 100A calculates the deviation of sheet Pa in the width direction by comparing the appropriate time with the detection time that is based on the detection result of one of detector 110 and detector 112.

In a step S26A, based on the calculated deviation amount in the width direction, post-processing apparatus 100A moves punching apparatus 120A from the expected punching position by the calculated deviation amount in the width direction.

In a step S28A, post-processing apparatus 100A sets punching timings of corresponding punch motors based on the timings at which detector 110 and detector 112 detect the predetermined feature portions.

More specifically, after passage of a predetermined time from the detection of the predetermined feature portion (for example, line 172*a*) included in mark 170*a* by detector 110, control unit 150 of post-processing apparatus 100A outputs, to punching apparatus 120A, a control signal for driving punch motor 126. Moreover, after passage of a predetermined time from the detection of the predetermined feature portion (for example, line 172*b*) included in mark 170*b* by detector 112, control unit 150 outputs, to punching apparatus 120A, a control signal for driving punch motor 124.

Based on the respective control signals from control unit 150, punch motors 124 and 126 of punching apparatus 120A punch sheet Pa in accordance with the deviation amount of sheet Pa in the transportation direction.

According to the description above, post-processing apparatus 100A according to the present embodiment can correct not only the deviation of sheet Pa in the width direction but also the deviation of sheet Pa in the transportation direction before punching.

It should be noted that in another aspect, post-processing apparatus 100A may be configured to cancel punching sheet Pa when the deviation amount of sheet Pa in the transportation direction is more than a predetermined value. In this case, control unit 150 cancels punching sheet Pa when the difference between the respective timings at which detector 110 and detector 112 detect the predetermined feature portions included in the corresponding marks is more than a predetermined value.

Furthermore, in still another aspect, in order to detect the deviation of sheet Pa in the transportation direction, post-processing apparatus 100A may be configured to detect downstream end portion EL of sheet Pa in the transportation direction, rather than the feature portions included in the marks.

In this case, control unit 150 of post-processing apparatus 100A drives punch motor 126 after passage of a predetermined time from the detection of downstream end portion EL of the sheet by detector 110, and drives punch motor 124 after passage of a predetermined time from the detection of end portion EL by detector 112.

[E. Modification]

In addition to the first and second embodiments described above, the following describes modifications below. It should be noted that the modifications indicated below are applicable to any of the first and second embodiments, and any combination can be employed.

(e1. Modification 1—Detector is Disposed at Downstream Side Relative to Punching Apparatus)

In each of the embodiments described above, the detector(s) are disposed at the upstream side relative to the punching apparatus in the transportation direction of the sheet. In the present modification, a detector is disposed at the downstream side relative to the punching apparatus in the transportation direction of the sheet. It should be noted that the basic configuration of a post-processing apparatus 100B according to the present modification is substantially the same as post-processing apparatus 100 according to the first embodiment, so that the following describes only a difference therefrom.

Figure 12:
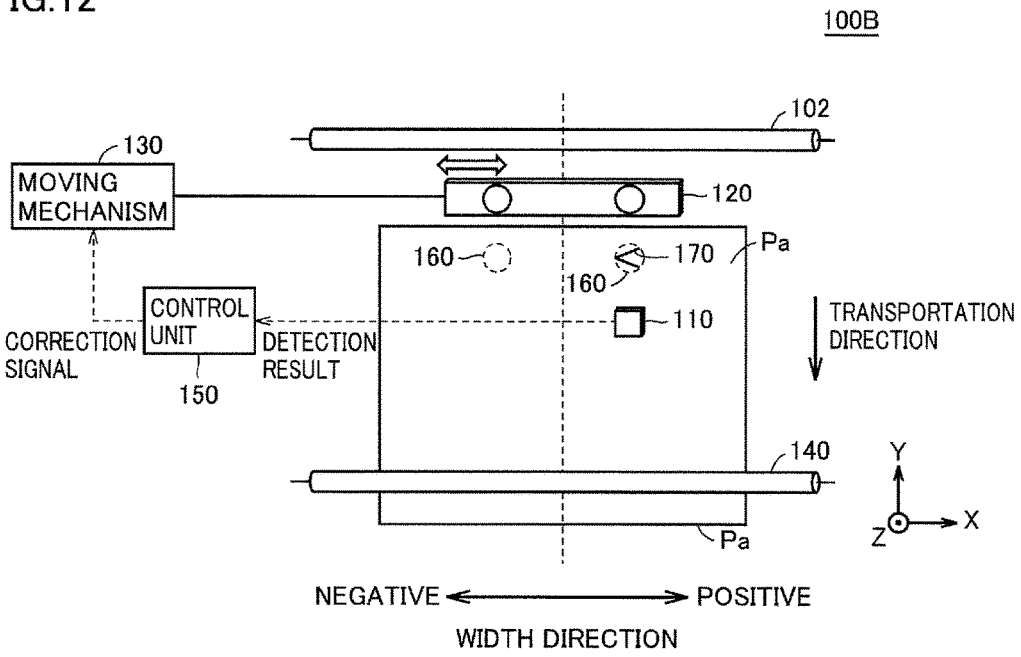
FIG. 12 illustrates an exemplary configuration of a post-processing apparatus according to a modification 1.

FIG. 12 illustrates an exemplary configuration of post-processing apparatus 100B according to modification 1. In post-processing apparatus 100B, detector 110 is disposed at the downstream side relative to punching apparatus 120 in the transportation direction of the sheet.

As with the above embodiments, on sheet Pa, a mark 170 is formed within expected punching region 160. Control unit 150 calculates the deviation of the sheet in the width direction based on a difference between respective timings at which a line 172 and a line 174, which are the feature portions included in mark 170, are detected by detector 110. Accordingly, control unit 150 causes moving mechanism 130 to move punching apparatus 120 from the expected punching position by the calculated deviation amount in the width direction.

Moreover, when it is determined that detector 110 has detected mark 170, control unit 150 rotates transporting roller pair 140 in a direction reverse to the transportation direction and stops rotation of transporting roller pair 102. Accordingly, sheet Pa is brought into abutment with transporting roller pair 102, thereby temporarily stopping the transportation. Punching apparatus 120 punches sheet Pa with the transportation of sheet Pa being stopped. Then, transporting roller pairs 102, 140 are rotated in the transportation direction again based on a rotation signal from control unit 150, thereby discharging sheet Pa to sheet discharging unit 104.

According to the above configuration, the post-processing apparatus according to the present modification can correct a position of punching by punching apparatus 120, by calculating the deviation amount of sheet Pa in the width direction even when the detector can be disposed only at the downstream side relative to the punching apparatus due to the configuration of the apparatus or the like.

It should be noted that when this configuration is applied to post-processing apparatus 100A according to the second embodiment, control unit 150 causes punching apparatus 120A to punch while sheet Pa is being transported to the direction reverse to the transportation direction, without stopping the rotation of transporting roller pair 102.

(e2. Modification 2—Shape of Mark)

In each of the above-described embodiments, the mark has a "V-like" shape and is configured such that the interval between the feature portions in the transportation direction is decreased or increased in proportion to a change in the width direction; however, the shape of the mark is not limited to this.

The mark may be configured in any manner as long as the mark includes a plurality of feature portions extending in the width direction and an interval between the feature portions in the transportation direction is changed depending on the width direction. The following describes exemplary configurations of other marks.

Figure 13A:
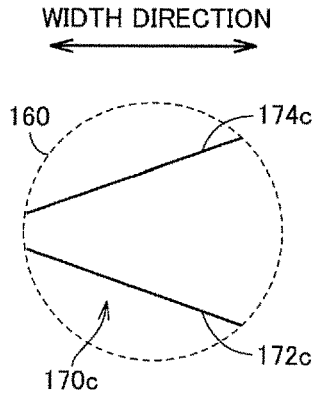
FIG. 13A is a (first) diagram illustrating an exemplary configuration of another mark.
Figure 13B:
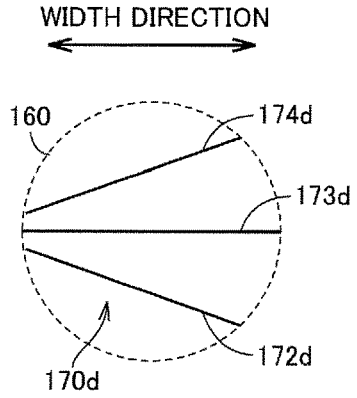
FIG. 13B is a (second) diagram illustrating an exemplary configuration of another mark.
Figure 13C:
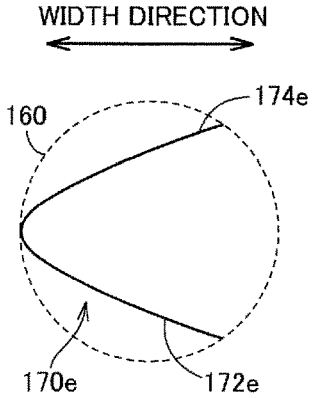
FIG. 13C is a (third) diagram illustrating an exemplary configuration of another mark.

FIG. 13A to FIG. 13C illustrate the exemplary configurations of the other marks. A mark 170*c* shown in FIG. 13A has such a shape that a line 172*c* and a line 174*c*, which are feature portions extending in the width direction, are not in contact with each other.

A mark 170*d* shown in FIG. 13B has three feature portions extending in the width direction, i.e., lines 172*d*, 173*d*, 174*d*.

A mark 170*e* shown in FIG. 13C is configured such that an interval between lines 172*e* and 174*e*, which are feature portions extending in the width direction, in the transportation direction is monotonously decreased or monotonously increased, rather than being proportional to a change in the width direction.

When any one of marks 170*c* to 170*e* indicated above is used, the post-processing apparatus according to each of the above-described embodiments can correct the deviation of the sheet in the width direction and the deviation of the sheet in the transportation direction before punching.

It should be noted that when mark 170*d* is used, the post-processing apparatus can correct the deviation of the sheet in the width direction based on a difference between respective timings at which any two of lines 172*d*, 173*d*, and 174*d* are detected.

(e3. Modification 3—Printing of Mark by Image Forming Apparatus 200)

As one example, it is assumed that image forming apparatus 200 is an image forming apparatus according to an electrophotography method. In this case, in the punch mode, image forming unit 220 of image forming apparatus 200 may be configured to change an amount of a toner used to print the mark, based on a remaining amount of the toner.

For example, when the mark is printed using a black toner, image forming unit 220 is configured to reduce the amount of the black toner used to print the mark as the remaining amount of the black toner is decreased.

According to the description above, image forming apparatus 200 can reduce an amount of consumption of the toner used to print the mark.

Moreover, when image forming apparatus 200 is configured to be capable of forming a color image using toners of a plurality of colors, image forming unit 220 may be configured to be capable of changing a toner to be used to print the mark, based on respective remaining amounts of the toners of the colors.

For example, image forming unit 220 may be configured to print the mark using a toner having the largest toner remaining amount.

According to the description above, image forming apparatus 200 can avoid the amount of consumption of a toner of a specific color from being increased when printing the mark.

It should be noted that image forming apparatus 200 may be an image forming apparatus according to a so-called ink jet method, and may be configured to control an ink to be used, when printing the mark.

(e4. Modification 4—Punching Apparatus)

In each of the above-described embodiments, the punching apparatus is a two-hole type punching apparatus for punching at two positions, but is not limited to this. The punching apparatus may be configured in any manner as long as the punching apparatus punches at one or more positions along the width direction of the sheet. For example, the punching apparatus may be such a type of punching apparatus that punches at 3, 4, 6, 22, 26, or 30 positions. In the punching apparatus configured to be capable of punching at a plurality of positions, intervals between the punching positions are preferably equal to one another. Moreover, the punching apparatus configured to be capable of punching at a plurality of positions may be configured to be capable of punching any of the plurality of positions.

It should be noted that punching apparatus 120A according to the second embodiment may be configured in any manner as long as it is an apparatus configured to be capable of punching at two or more positions along the width direction of the sheet.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A post-processing apparatus comprising:

a transporting mechanism that transports a sheet in a predetermined transportation direction;

a punching apparatus that punches the sheet;

a moving mechanism that moves the punching apparatus in a width direction orthogonal to the transportation direction; and a sensor disposed on a transportation path for the sheet, wherein:

the sensor optically detects a mark formed on the sheet and indicates a position to be punched, the mark includes a plurality of feature portions extending in the width direction, an interval between the feature portions in the transportation direction changes based on the width direction, the moving mechanism determines a position of the punching apparatus in the width direction based on a difference between respective timings of detection of the plurality of feature portions by the sensor, the punching apparatus punches the sheet at a plurality of positions along the width direction at a predetermined interval, and the mark is formed on the sheet at least one of the plurality of positions to be punched by the punching apparatus.

2. The post-processing apparatus according to claim 1, wherein the interval between the feature portions in the transportation direction monotonously increases or monotonously decreases based on a change in the width direction.

3. The post-processing apparatus according to claim 1, wherein the punching apparatus punches the sheet at a predetermined punching position when the sensor does not detect the mark.

4. The post-processing apparatus according to claim 1, wherein the punching apparatus cancels punching the sheet when the sensor does not detect the mark.

5. The post-processing apparatus according to claim 1, wherein the mark is formed at each of a plurality of positions of the sheet along the width direction, and the sensor detects the mark formed at each of the plurality of positions.

6. The post-processing apparatus according to claim 5, wherein the punching apparatus punches the sheet at the plurality of positions along the width direction at independent timings, a punching timing is set in the punching apparatus for each of the plurality of positions based on a difference between a timing at which a predetermined feature portion included in a first mark of the marks at the plurality of positions is detected and a timing at which a predetermined feature portion included in a second mark of the marks at the plurality of positions is detected, and the second mark is different from the first mark.

7. The post-processing apparatus according to claim 6, wherein the punching apparatus cancels punching the sheet when the difference between the timing at which the first mark is detected and the timing at which the second mark is detected is not less than a predetermined value.

* * * * *